United States Patent [19]

Fernandez et al.

[11] Patent Number: 4,786,463

[45] Date of Patent: Nov. 22, 1988

[54] EMERGENCY HEAT EXCHANGER FOR COOLING THE PRIMARY FLUID OF A NUCLEAR REACTOR, AND A PROCESS FOR ASSEMBLING THIS HEAT EXCHANGER

[75] Inventors: Luis Fernandez, Palaiseau; Gérard Stalport, Grigny, both of France

[73] Assignee: Novatome, Le Plessis-Robinson, France

[21] Appl. No.: 760,211

[22] Filed: Jul. 25, 1985

[30] Foreign Application Priority Data

Jul. 26, 1984 [FR] France ..... 84 11858

[51] Int. Cl.[4] ..... G21C 15/18

[52] U.S. Cl. ..... 376/299; 165/163; 376/298; 376/405

[58] Field of Search ..... 376/298, 299, 405; 165/163

[56] References Cited

U.S. PATENT DOCUMENTS

| | | | |
|---|---|---|---|
| 2,394,868 | 2/1946 | Morgenier | 165/163 |
| 3,379,244 | 4/1968 | Gilli | 165/163 |
| 3,805,890 | 4/1974 | Boardman et al. . | |
| 4,117,885 | 10/1978 | Nickerson et al. | 165/163 |
| 4,186,799 | 2/1980 | Nickerson et al. | 165/163 |
| 4,198,929 | 4/1980 | Forestier et al. | 165/163 |
| 4,204,502 | 5/1980 | Forestier et al. | 165/163 |

FOREIGN PATENT DOCUMENTS

| | | |
|---|---|---|
| 83545 | 7/1983 | European Pat. Off. . |
| 1438672 | 4/1966 | France . |
| 2106620 | 5/1972 | France . |
| 2171869 | 9/1973 | France . |
| 1167723 | 10/1969 | United Kingdom . |
| 1564821 | 4/1980 | United Kingdom . |
| 83/02821 | 8/1983 | World Int. Prop. O. . |

*Primary Examiner*—Deborah L. Kyle
*Assistant Examiner*—Richard W. Wendtland
*Attorney, Agent, or Firm*—Pollock, Vande Sande & Priddy

[57] ABSTRACT

A liquid metal cooled pool type nuclear reactor incorporates an emergency heat exchanger having a novel geometry. The heat exchanger comprises circular and annular tube plates coaxially aligned. The tube bundle has a vertical straight part connected to the central tube plate, a bent horizontal circular portion extending over one-third of the heat exchanger's circumference for returning the bundle, and a vertical straight return part joining the peripheral tube plate.

8 Claims, 4 Drawing Sheets

FIG.3a
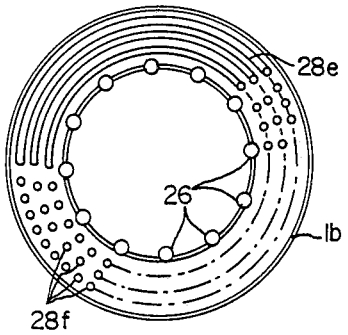
FIG.1
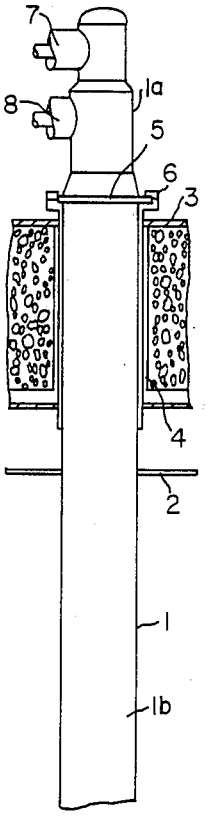
FIG.3b
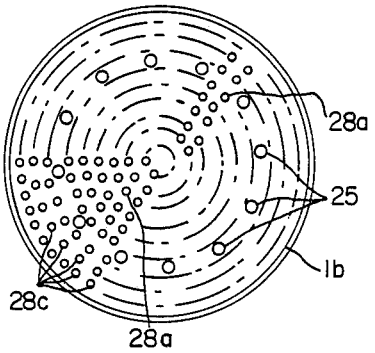
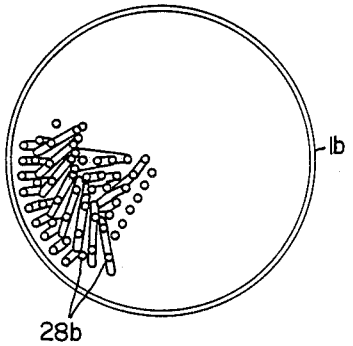
FIG.3c

EMERGENCY HEAT EXCHANGER FOR COOLING THE PRIMARY FLUID OF A NUCLEAR REACTOR, AND A PROCESS FOR ASSEMBLING THIS HEAT EXCHANGER

FIELD OF THE INVENTION

The invention relates to an emergency heat exchanger for cooling the primary fluid of a nuclear reactor the core of which, consisting of fuel assemblies which release heat, is immersed in a primary fluid contained in a vessel.

BACKGROUND OF THE INVENTION

In the case of fast-neutron nuclear reactors, the primary fluid for cooling the reactor generally consists of liquid sodium filling a stainless steel vessel of large dimensions closed by a very thick horizontal slab.

When the reactor is stopped after a period of operation, it is necessary to continue the cooling of the core assemblies, because some residual radioactivity remains, generating heat in this core.

In high-power nuclear reactors, the quantity of heat to be removed is large and the principal heat exchange circuit of the reactor is generally used to carry out its cooling after stopping. In the case of integrated-type reactors, this circuit incorporates intermediate sodium-sodium exchangers and pumps for circulating the primary sodium. These pumps operate at a low speed during the cooling after stopping.

However, if a technical incident causes a stoppage of the normal operation of the principal cooling circuit, the core can no longer be adequately cooled. Excessive heating of the core can result in very severe accidents, so that an emergency cooling circuit, completely separate from the principal circuit, of great simplicity and high reliability, is provided.

Such an emergency circuit incorporates a sodium-sodium heat exchanger partly immersed in the primary reactor fluid. This heat exchanger incorporates a bundle of tubes inside which circulates secondary sodium which heats up in contact with the primary sodium present in the reactor vessel. The secondary sodium circulated through the bundle is itself cooled outside the reactor vessel, in a sodium-air exchanger.

In the case of fast-neutron reactors of high power, for example 1,500 or 1,800 Mwe, it is necessary to employ several sodium-sodium emergency exchangers immersed in the reactor vessel. It is necessary to restrict the number of these sodium-sodium emergency exchangers for cost reasons, and to reduce the number of passages in the reactor slab. The sodium-sodium emergency exchangers must therefore be relatively large.

Furthermore, these heat exchangers are subjected to very high thermal stresses, with the result that their design presents technical problems which are difficult to solve.

In the majority of cases, the sodium-sodium emergency exchangers are of the type with bundles of hairpin tubes immersed directly in the primary sodium. These tubes are placed inside an outer shell which is open at its base and perforated over a large part of its side surface.

The U-tubes are joined at one of their ends to a first tube plate, and at their other end to a second tube plate offset relative to the first along the height of the heat exchanger. These tube plates enable the secondary sodium in the tubes to be sent to the central part of the exchanger and to be recovered at its peripheral part. The cooled sodium descends in the tube branches situated at the central part of the exchanger and rises in the tube branches situated at the periphery of the latter. While travelling in the tubes, the secondary liquid sodium heats up in thermal contact with the primary sodium through the tube walls. This results in very large temperature differences between the various parts of the exchanger. The latter can also be subjected to large temperature changes over time. This results in thermal stresses which can be very high in some parts of the exchanger, and it is necessary to design exchangers of such structure that it enables these thermal stresses to be reduced to acceptable levels.

Furthermore, the tubes forming the exchange bundle must be efficiency braced to prevent their relative movement under the effects of heat and vibrations. The gives rise to problems in the assembly of the heat exchanger which are difficult to resolve.

SUMMARY OF THE INVENTION

The object of the invention is consequently to offer an emergency heat exchanger for cooling the primary fluid of a nuclear reactor contained in a vessel incorporating a substantially horizontal closure plate and enclosing the reactor core immersed in the primary fluid, incorporating a support flange resting on the closure plate, a bundle of exchange tubes bent into a hairpin and fixed to two tube plates, a cylindrical shell with a vertical axis surrounding the bundle which is submerged in the primary fluid, and a circuit for feeding the tubes of the bundle with a heat exchange fluid, incorporating a means of cooling the exchange fluid heated by the primary fluid arranged outside the vessel, a heat exchanger which makes it possible to restrict the thermal stresses in its various component members and has a simple structure which is permits easy assembly.

To this end, the two tube plates are placed coaxially, horizontally and at the same level, one of these tube plates, of annular shape, situated peripherally relative to the second central plate, circular in shape, being fixed to a shell having a vertical axis and situated above the tube plates and connecting the latter to the support flange and to a second shell coaxial with the first, situated below the tube plates, and carrying a connecting piece of a third shell connected to the central tube plate, and each of the tubes of the bundle incorporates a vertical straight part connected to the central tube plate, a bent part for returning the tube, a vertical straight return part, a horizontal circular portion over approximately one-third of the circumference and a vertical part joining the peripheral tube plate.

The invention also relates to a process for assembling the heat exchanger.

BRIEF DESCRIPTION OF THE DRAWINGS

In order that the invention may be more clearly understood, a description will now be given, by way of a example, of an emergency heat exchanger for a fast-neutron nuclear reactor cooled by liquid sodium.

FIG. 1 is an elevation view of the emergency heat exchanger in position in the vessel of a fast-neutron nuclear reactor.

FIG. 3*a* is a cross-section along A—A of FIG. 2*b*.

FIG. 3*b* is a cross-section along B—B of FIG. 2*b*.

FIG. 3*c* is a cross-section along C—C of FIG. 2*b*.

FIGS. 5 and 5*a* are top views of a part of this spacer, on different scales.

FIG. 6 is a view in direction F of FIG. 5*a*.

FIG. 7 is a partial elevation view of the means for holding the members of the spacer.

DESCRIPTION OF PREFERRED EMBODIMENT

Figure 2B:
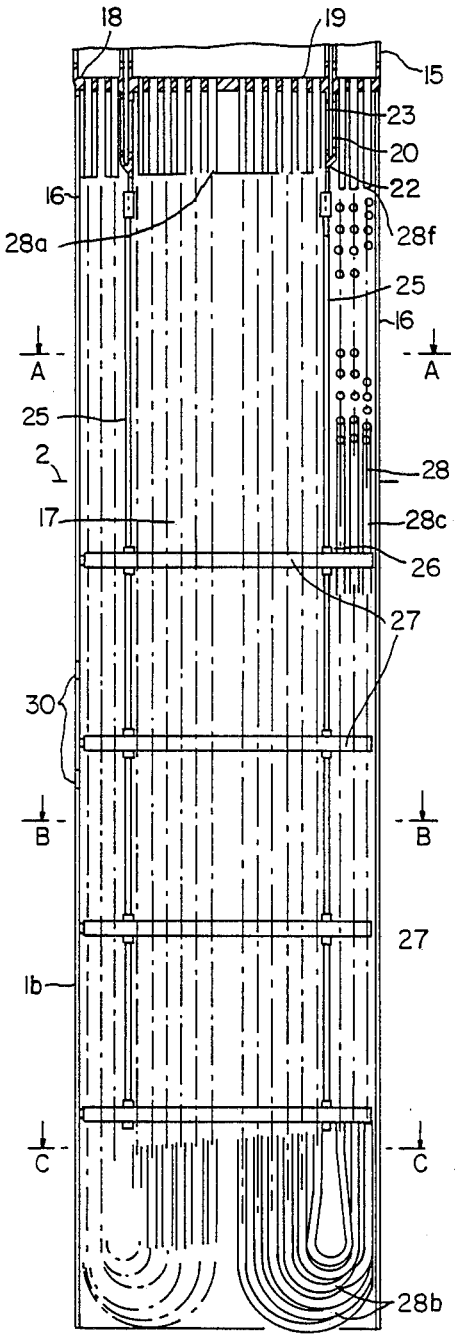
FIG. 2*b* is a view in section through a vertical plane of symmetry of the lower part of the heat exchanger shown in FIG. 1.

FIG. 1 shows the heat exchanger, referred to as a whole by reference 1, in position inside the vessel of the fast-neutron nuclear reactor filled with liquid sodium up to level 2. The heat exchanger 1 crosses the slab 3 via a passage 4 and rests through the intermediary of a flange 5 on a support flange 6 carried by the shell of the passage 4 through the slab 3.

To the upper part 1*a* of exchanger 1 are fixed insulated lines 7 and 8 ensuring, respectively, the return of the secondary sodium cooled in the heat exchanger and the withdrawal of the heated secondary sodium which is sent, in order to be cooled, to a sodium-air heat exchanger (not shown) arranged outside the vessel and situated in the secondary sodium circuit.

The lower part 1*b* of the exchanger consists of a shell with a vertical axis incorporating perforations and surrounding the exchange bundle.

The structure of the heat exchanger 1 will now be described in greater detail with reference to FIGS. 2*a* and 2*b*.

It can be seen that the upper part of the heat exchanger incorporates an outer enclosure to which are fixed sodium lines 7 and 8 communicating inside the heat exchanger enclosure with, respectively, a chamber 10 for arrival of the secondary liquid sodium and a chamber 11 for return of the heated secondary sodium.

The arrival and return chambers 10 and 11 for secondary liquid sodium are coaxial and have the vertical axis ZZ' of the heat exchanger as their common axis.

The secondary sodium arrival chamber 10 is arranged in the central part and incorporates a double wall. The return chamber 11 for the heated secondary sodium, annular in shape, is arranged at the periphery of chamber 10. Chambers 10 and 11 consist of cylindrical shells and frusto-conical shells welded end to end.

The space included between the two walls of chamber 10 is filled with an inert gas.

The space included between the outer wall of the cylindrical part of chamber 11 and the outer enclosure of the heat exchanger is filled with lagging blocks 12. Lagging is also arranged in the extension of these blocks 12 around lines 7 and 8. A metal block 13, arranged around the frusto-conical part of chambers 10 and 11, makes it possible to implement biological protection of the passage 4.

Under flange 5 are fixed two coaxial shells 14 between which is left a very narrow space sufficient in height to surround the heat exchanger enclosure 1 over the entire height of the passage 4. These shells 14 form a conventional thermal protection of the passage.

Also fixed under flange 5 is a thicker shell 15 forming the outer wall of the heat exchanger joining the flange 5 to the lower part 1*b* of the exchanger. In this part 1*b* of the exchanger is the bundle 17 formed by a set of hairpin-bend tubes, each of which comprises an end connected to an outer tube plate 18 of annular shape and an end connected to a central tube plate 19 of circular shape.

The tube plates 18 and 19 are both coaxial with the axis ZZ' of the heat exchanger face each other at the same elevation in this heat exchanger, the annular plate 18 surrounding the circular plate 19.

The tube plate 18 is connected over its periphery to the heat exchanger shell 15, which thus ensures the connection between the tube plate 18 and the flange 5. On its inner edge, the annular plate 18 is connected to one of the walls of the secondary sodium arrival chamber 10. Lastly, over its periphery and in its upper part, the central plate 19 is connected to the second enclosure of chamber 10.

The enclosure of chamber 11 is connected to the shell 15 in its lower part through the intermediary of a Y-shaped component 21.

The shell 15 is extended below the tube plates 18 and 19 by the shell 1*b* surrounding the heat exchanger tube bundle. This shell 1*b* is fixed by welding along the outer edge of the annular plate 18, below this plate.

Along the inner edge of the plate 18, on its lower face, is fixed a short shell 20. The lower part of this shell 20 is connected to an annular connecting piece 22 with a Y-shaped cross-section, which makes it possible to connect the shell 20 to a shell 23, substantially identical in length, coaxial with shell 20, and fixed along the edge of the central plate 19 on its lower face.

Tie rods 25, whose circumferential distribution can be seen in FIGS. 3*a* and 3*b*, are fixed to the lower part of the annular piece 22 with a Y-shaped cross-section. These tie rods 25 hold, through the intermediary of short sleeves 26, a set of spacer grids 27 ensuring the transverse retention of the tubes 28 of the bundle 17.

Each of the bundle tubes 28 incorporates a descending straight part 28*a* fixed at its top end in the tube plate 19, a bent part for returning the tube 28*b*, a straight return part 28*c*, a horizontal circular portion 28*e* which can be seen in FIG. 3*a* and, finally, a straight end part 28*f* fixed inside the tube plate 18. In this manner, for each of the tubes 28, the inlet end communicates with the sodium arrival chamber 10 and the outlet end with the liquid sodium return chamber 11. Since the lower part of the heat exchanger up to the liquid sodium level 2 is immersed in the primary sodium to be cooled, the secondary sodium circulating in the tubes 28 heats up before emerging into the chamber 11. The various parts of the tubes and of the heat exchanger are thus at different temperatures. The primary sodium is in contact with the bundle over its entire immersed length and perforations 30 are provided for the passage of the primary sodium into the enclosure 1*b*.

The upper part of the tube portions 28*a*, the circular portions 28*e* as a whole and the portions 28*f* are arranged above the primary liquid sodium level 2.

The differential expansion of the tube portions subjected to fluids at different temperatures is largely compensated by the circular portion 28*e* of the tube, which is arranged above the liquid sodium level. These portions are thus subjected to flexions which they are able, however, to absorb without undue difficulties, given their length corresponding to an arc of circumference supporting a center angle of the order of 140° and in any case greater than 120°, i.e., to one-third of the circumference. Furthermore, these circular portions 28*e* are not subjected to excessively favourable use conditions, being situated above the primary liquid sodium level.

The two tube plates 18 and 19 incorporate means of connection both to each other and to the exchanger support flange 5, which make it possible to absorb any distortion of the bundle and of the exchanger shells. At the same time, these connecting means permit an efficient retention of the tube plates and of the outer shell 1*b* of the bundle. In addition, the transverse retention of the bundle against vibrations is ensured by the spacers 27 fixed to the lower part of the annular connecting piece 22.

Figure 2A:
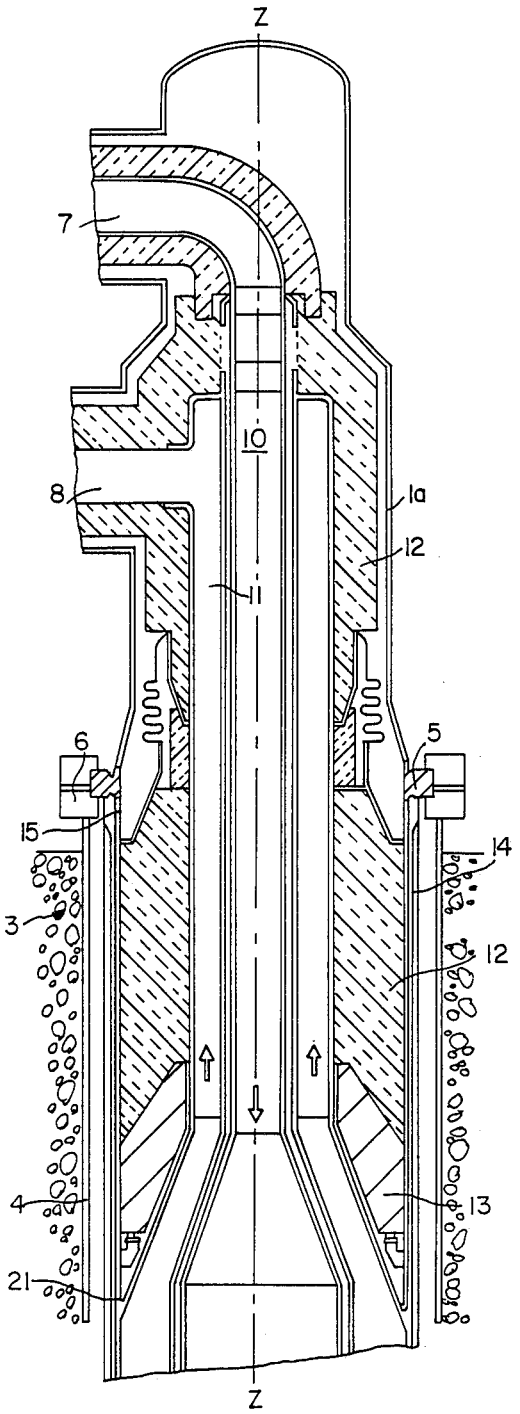
FIG. 2*a* is a view in section through a vertical plane of symmetry of the upper part of the emergency heat exchanger shown in FIG. 1.

The bundle base, consisting of the bent portions 28*b* which can be seen in FIGS. 2*b* and 3*c*, consists of a mere placing side by side of hairpin tubes having good distortion resistance in transverse directions.

Figure 4:
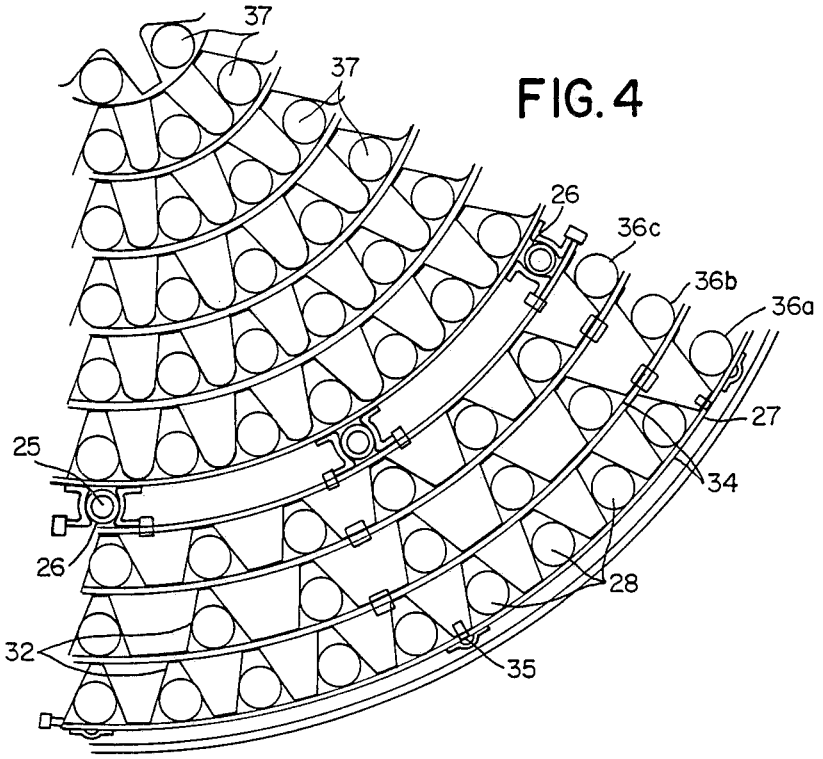
FIG. 4 is a top view of a part of a spacer for holding the tubes of the heat exchanger shown in FIG. 1.

FIG. 4 shows an embodiment of a spacer grid 27 for fixing the tubes 28. This spacer grid 27 consists of a set of circular and concentric hoops 34, all coaxial with the heat exchanger axis ZZ', and between which there are arranged metal strips 32 with sinusoidal folds, fixed on each side to the corresponding hoops. The hoops 34 consist of successive portions connected by welded connecting pieces 35. The sinusoidally folded strips 32 ensure the connection between the various hoops and form therewith three outer retaining rings 36*a*, 36*b* and 36*c* and six inner rings 37.

Between the set of inner rings 37 and the outer rings 36 a space is provided in which the sleeves 26 for retaining the tie rods 25 are fixed by virtue of pieces which also permit the connection between the inner part of the spacer grid and the outer part.

The tie rods 25 ensure the suspension of the spacer grid 27 under the tube plates.

The process for assembling the tubes 28 in the spacer grids 27 will be described hereinbelow.

Figure 5:
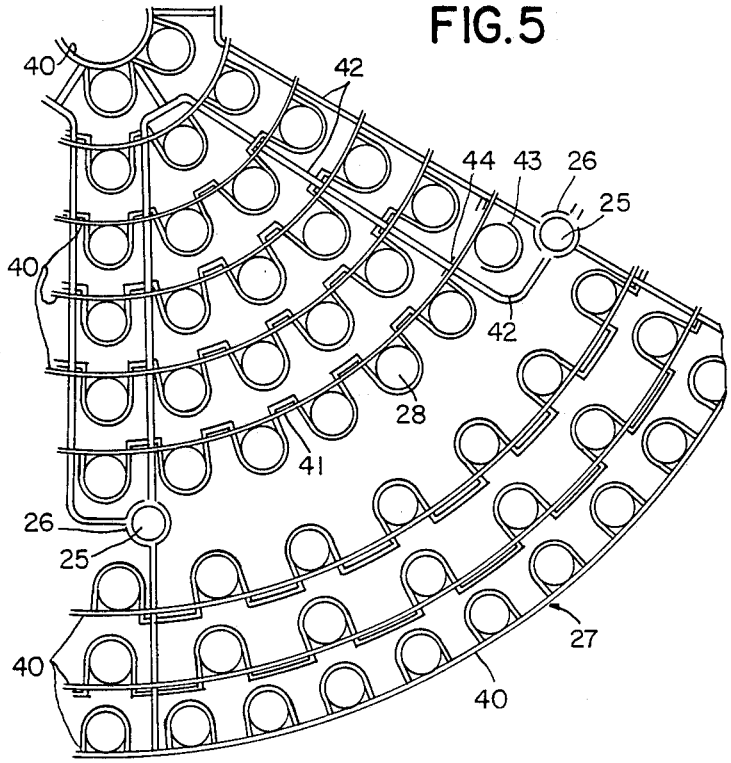
FIGS. 5, 6 and 7 relate to a second embodiment of a spacer for holding the tubes.
Figure 7:
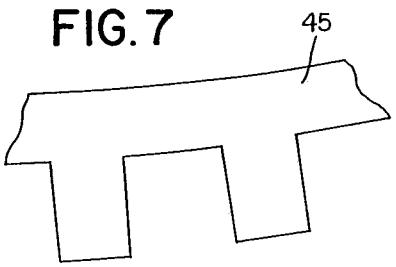
Figure 6:
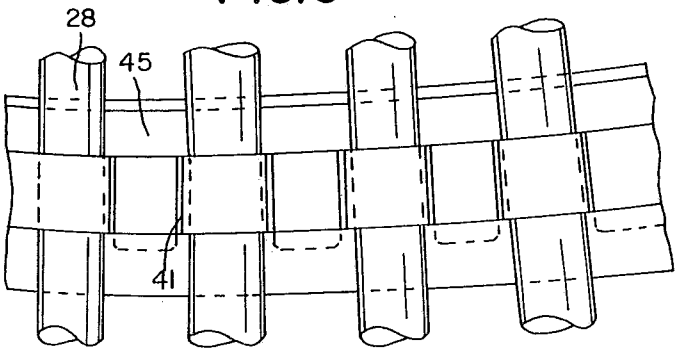
Figure 5A:
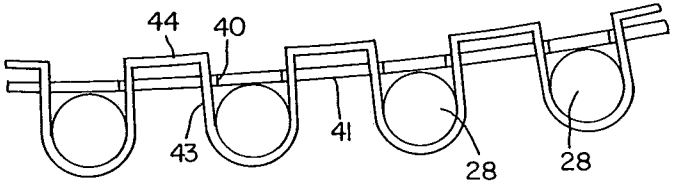

FIGS. 5, 6 and 7 show a second embodiment of a spacer grid, in this case incorporating a set of concentric hoops 40, all coaxial with the heat exchanger axis ZZ'. These hoops 40 incorporate rectangular cutouts 41 such as can be seen in FIG. 6, and the skeleton of the grid consists, in addition to the hoops 40, of radial members 42 and a metal strip 43 folded so as to provide a housing for the tubes 28 between the metal strip 43 and the corresponding hoop 40. Between two portions which are folded cylindrically to come into contact with the tubes 28, the metal strip 43 is folded at right angles to form a part corresponding in size to the cutouts 41 in the hoop 40. These rectangular portions 44 folded at right angles are introduced into the cutouts 41 in the hoop 40 and held in place by the components 45 acting as a stirrup. These components 45 have the shape of ring portions cut out slot-wise, as can be seen in FIG. 7, or of combs.

The concentric hoops 40, the radial components 42 and the metal strip 43, forming the skeleton of the grid 27, are connected together to ensure the cohesion of the structure. The radial components 42 also carry the sleeves 26 for fixing the tie rods 25 by which the grid 27 is suspended.

Both in the case of the grid shown in FIG. 4 and in the case of the grid shown in FIGS. 5, 6 and 7, the assembly and the fixing of the various components of which they consist are carried out for the set of the six inner rings, before the assembly of the bundle.

For assembling the bundle, the lower parts of the spacer grids suspended by the tie rods 25 are installed under the tube plates 18 and 19 and then the branches 28*a* of the tubes 28 are introduced into the spacer grids one by one so as to form a complete first inner layer. The ends of the tubes 28 are then connected to the tube plates 18 and 19, respectively and the outer hoops are installed so as to form a first outer ring for fixing the tubes 28. The fixing components 32 (FIG. 4) or such as 43 and 45 (FIG. 5) are connected to the hoop(s) installed in the outer part of the grid.

The two succeeding layers are built up in succession in the same manner.

When the whole of the bundle and the spacer grids. have been assembled in this way, the outer shell 1*b* surrounding the bundle is installed, and then this shell 1*b* is fixed by welding on the tube plate 18.

In the case of the grid shown in FIGS. 5, 6 and 7, the tubes 28 are first installed against the hoops 40, then the fixing components 43 are introduced into the cutouts 41 in the hoops 40. Finally, the whole is immobilized by the comb-shaped components 45.

Figure 8:
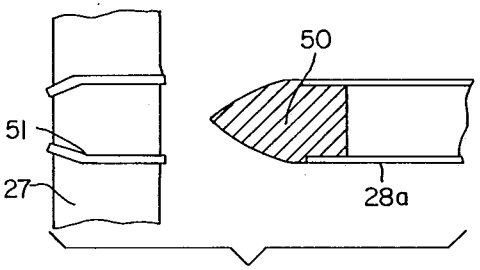
FIG. 8 is a sectional view of the members permitting the assembly of the bundle tubes in the spacers.

For assembling the preassembled inner parts of the spacer grids and for assembling the tubes in these preassembled parts, use is made of the means shown in FIG. 8, which shows the end 28*a* of the tube 28 during assembly in a grid 27. An ogive-shaped tip 50 is fitted to the end of the tube 28*a* to be introduced into the grid 27 which incorporates sleeves 51 having the same inner and outer diameters as the tubes 28 which have been installed at the time of the assembly of the grid components in the location to be occupied by the tubes, to maintain a separation of these components which corresponds exactly to the dimension of the tubes 28. The sleeves 51 are retained by the radial forces exerted by the resilient components forming the grid 27.

When the end of the tube 28 incorporating the ogive-shaped tip 50 is introduced into the sleeve 51, the latter is driven out by pushing, while the tube 28 takes up its place in the spacer grid 27. The tube 28*a* is thus held perfectly in the spacer grid.

The principal advantages of the heat exchanger according to the invention are to permit expansions of the various parts of this exchanger during its operation and, in particular, of the tubes of the bundle, without producing excessive stresses in these components.

The whole assembly of the exchanger components is also perfectly held against vibrations, in particular in the transverse direction.

The fitting of the tube plates at the same height in the exchanger makes it possible to optimize the structure of the heat exchanger while allowing them relative movements under the effective of expansions.

Finally, the heat exchanger according to the invention may be produced by simple and perfectly defined assembly operations.

The invention is not restricted to the embodiment which has just been described; on the contrary, it incorporates all the alternative forms.

Thus, the length of the shells 20 and 23 for connecting the tube plates and for suspending the spacer grids can vary within certain limits. In practice, this length L of the shells 20 and 23, in the case of a heat exchanger such as is employed in a fast-neutron nuclear reactor, may be such that it obeys the following inequalities:

$$3\sqrt{Rt} < L < 5\sqrt{Rt}$$

where R is the radius of the outer shell 1*b* of the heat exchanger and t the thickness of the connection shells.

In the case of the heat exchangers in fast-neutron nuclear reactors, this thickness is generally between 6 and 10 mm.

In such heat exchangers the difference in temperature T between the hottest and the coldest parts is generally in the region of 200° C.

It is also possible to produce spacer grids in a manner different from those which have been described.

Finally, the folding of the bundle tubes can be slightly different from that which has been described and shown.

The invention applies in all the cases where an emergency exchanger is used for cooling the primary fluid of a nuclear reactor, this heat exchanger being immersed in a vessel containing the primary fluid.

What is claimed is:

1. In a liquid metal cooled pool type nuclear reactor having a vessel filled with liquid metal, a reactor core disposed in said vessel, a slab sealing said vessel, an emergency heat/exchanger comprising a support flange resting on the slab, a bundle of exchange tubes bent into a hairpin shape and fixed to two tube plates, a cylindrical shell with a vertical axis surrounding the bundle which is submerged in the liquid metal and a circuit for feeding the tubes of the bundle with a heat exchange fluid, incorporating a means of cooling the exchange fluid heated by the liquid metal and arranged outside the vessel, the two tube plates being placed coaxially, horizontally and at the same level, one of these tube plates, of annular shape, situated peripherally relative to the second, central plate, circular in shape, being fixed to a shell having a vertical axis and ensuring the latter to be borne by the support flange and to a second shell coaxial with the first, situated below the tube plates, and connected to a third shell connected to the central tube plate, the improvement wherein the first shell is located above the tube plate, the second and third shells are connected by a connecting piece at their lower ends, and wherein each of the tubes of the bundle incorporates a vertical straight part connected to the central tube plate, a bent plate for returning the tube, a vertical straight return part, said parts being heat-exchanging parts of the tube, as well as a horizontal circular portion extending over approximately one-third of the circumference, and a vertical part joining the peripheral tube plate.

2. The improvement claimed in claim 1, wherein the connecting piece carries, at its lower part, a set of vertical tie rods for suspending the spacer grids holding the tubes of the bundle in the radial directions.

3. The improvement claimed in claim 1, wherein the second shell and the third shell have substantially equal lengths in the vertical direction, this length (L) being defined by the following inequalities:

$$3\sqrt{Rt} < L < 5\sqrt{Rt}$$

where R is the radius of the shell surrounding the exchanger bundle and t the thickness which is common to the shells.

4. The improvement claimed in claim 3, wherein the thickness of the shells joining the tube plates is between six and ten millimeters.

5. The improvement claimed in claim 1, wherein the horizontal circular portion of the tubes allowing them to expand is arranged in a heat exchanger zone situated above the level of the liquid metal in the nuclear reactor vessel.

6. The improvement claimed inc claim 2, wherein the spacer grids consist of a set of concentric and horizontal circular hoops to which are fixed resilient members for holding the tubes.

7. The improvement claimed in claim 6, wherein the resilient members are metal strips with sinusoidal folds which are inserted between two successive hoops to provide spaces for housing the tubes.

8. The improvement claimed in claim 6, wherein the hoops with a circular cross-section and cylindrical shape incorporate rectangular openings inside which are engaged rectangularly folded parts of a metal strip forming the resilient means for holding the tubes against one of the hoop faces, retention combs being introduced into the rectangularly folded parts of the resilient means of the side of the hoop face which is not in contact with the tube.

* * * * *